US005952166A

United States Patent [19]

Lok et al.

[11] Patent Number: 5,952,166

[45] Date of Patent: Sep. 14, 1999

[54] ENHANCED SENSITIVITY FROM THIOLONE DIOXIDES IN CUBIC SILVER CHLORIDE EMULSIONS WITH SHARP CORNERS

[75] Inventors: Roger Lok, Rochester; Jerzy Z. Mydlarz, Fairport, both of N.Y.

[73] Assignee: Eastman Kodak Company, Rochester, N.Y.

[21] Appl. No.: 09/013,087

[22] Filed: Jan. 26, 1998

[51] Int. Cl.[6] ..... G03C 1/035; G03C 1/09; G03C 1/07

[52] U.S. Cl. ..... 430/567; 430/569; 430/600

[58] Field of Search ..... 430/567, 569, 430/600

[56] References Cited

U.S. PATENT DOCUMENTS

| | | | |
|---|---|---|---|
| 3,782,959 | 1/1974 | Bigelow | 430/596 |
| 4,150,093 | 4/1979 | Kaminsky et al. | 423/74 |
| 5,116,723 | 5/1992 | Kajiwara et al. | 430/611 |
| 5,399,479 | 3/1995 | Lok | 430/603 |
| 5,411,855 | 5/1995 | MacIntyre et al. | 430/603 |
| 5,413,905 | 5/1995 | Lok et el. | 430/600 |
| 5,500,333 | 3/1996 | Eikenberry et al. | 430/567 |
| 5,670,307 | 9/1997 | Lok | 430/611 |
| 5,693,460 | 12/1997 | Lok | 430/611 |
| 5,756,278 | 5/1998 | Lok | 430/600 |

*Primary Examiner*—Mark F. Huff
*Attorney, Agent, or Firm*—Paul A. Leipold

[57] ABSTRACT

The invention relates to an emulsion comprising sharp cornered silver chloride grains, said grains having a rounding index less than 0.3 and dithiolone dioxide.

17 Claims, No Drawings

ENHANCED SENSITIVITY FROM THIOLONE DIOXIDES IN CUBIC SILVER CHLORIDE EMULSIONS WITH SHARP CORNERS

FIELD OF THE INVENTION

This invention relates to color photographic emulsions, particularly those comprising silver chloride emulsions with sharp corners.

BACKGROUND OF THE INVENTION

In the manufacturing of color negative photographic printing papers, at least three light sensitive silver halide emulsion layers are used to capture the photographic image, i.e., red, green, and blue. These emulsions are placed in layers, and because of light scattering and absorption occurring in the upper layers, the lower layers receive less exposure.

The incandescent lamp normally used for exposing printing paper is low in energy output, particularly in a short wavelength region of the visible spectra. This reduces energy impinging on the layers of the photographic element. The color negative film to which the light is exposed onto the photographic printing paper often has masking dyes that give it a yellowish brown tint, further filtering the light and reducing the light available for exposure.

Nevertheless, there is a need to improve color reproduction of the original scene as captured in the color negative film. One way of achieving such an improvement is to employ more sensitive emulsions in the color print material. There exists a need to manufacture emulsions that have high sensitivity in order to overcome light deficiencies in exposure and capture the fidelity of the original color image.

Photofinishers also desire short processing times in order to increase the output of color prints. One way of increasing output is to increase the chloride content of emulsions, as chloride emulsions allow a higher development rate. Further, chloride ion in the development solution has less restraining action on development compared to bromide.

It has been recognized in the art that photographic sensitivity can be increased by adjusting the pH and/or the pAg of a silver halide emulsion.

Another way of attaining a high speed emulsion is through the use of reduction sensitization. Reducing agents such as stannous chloride, ascorbic acid, alkynylamino heterocycles (U.S. Pat. No. 5,399,479; U.S. Pat. No. 5,413,905; U.S. Pat. No. 5,500,333) and dimethylamine borane (U.S. Pat. No. 4,150,093 and U.S. Pat. No. 3,782,959) may be used. However, the use of such sensitizers may cause indiscriminate fog.

Thus there remains a need to achieve high speed silver halide photographic emulsion without the concommittant fog often associated with such speed increase.

Ripening agents have been used in photographic emulsions for making geometrically uniform grains. However, presence of ripening agents during precipitation can affect morphology of the grains. In general, the silver halide grains have rounded corners and edges, when precipitated in the presence of ripening agents. However, depending on the type of ripeners used, unwanted changes in the emulsion morphology may result. In addition, residual ripener adsorbed on the emulsion grain surface and not removed during washing and ultrafiltration may be carried over to subsequent emulsion preparation steps. Such remaining ripener may cause undesirable sensitization effects, and upon storage, deleterious fog. In the absence of ripening agents, silver halide grains produced have a narrower grain size distribution with sharper edges and corners.

Clearly, there exists a need to obtain emulsions with high sensitivity and narrow grain size distribution.

Recently, a new class of compounds has been reported to have benefits in stabilizing silver halide emulsions against such changes due to storage at high temperature and humidity. This class of heterocycle, in which one of the two sulfur atoms in a five-membered heterocyclic ring is oxidized to the tetravalent state (thiolone dioxide), has been disclosed in U.S. Pat. Nos. 5,693,460 and 5,670,307 and U.S. application Ser. No. 08/885,483 filed Jun. 30, 1997. U.S. Pat. No. 5,693,460 discloses the stabilizing properties on 3H-1,2-benzodithiol-3-one 1,1-dioxide. U.S. Pat. No. 5,670,307 discloses the combination of 3H-1,2-benzodithiol-3-one 1,1-dioxide with sulfinates. U.S. application Ser. No. 08/885,483, now U.S. Pat. No. 5,756,278, relates to the combination of water soluble gold sensitizers with thiolone dioxide compounds for enhanced emulsion sensitivity. U.S. Pat. No. 5,116,723 discusses the use of sulfur compounds for photographic use, and an example is provided in which a five-membered ring heterocycle contains three sulfur atoms.

PROBLEM TO BE SOLVED BY THE INVENTION

There is a continuing need for a better selection of materials to improve sensitivity with little or no increase in fog.

SUMMARY OF THE INVENTION

It is an object of the invention to overcome disadvantages of prior chloride emulsions.

It is another object to provide more light sensitive and uniform silver halide emulsions.

An object of the present invention is to provide a light sensitive photographic element that can achieve rapid processing and an increase in emulsion sensitivity.

These and other objects of the invention generally are accomplished by an emulsion comprising sharp cornered silver chloride grains, said grains having a rounding index of less than 0.3 and dithiolone dioxide.

ADVANTAGEOUS EFFECT OF THE INVENTION

The invention provides speed increases for silver halide emulsions without the use of sulfinates. Further, the instant invention can utilize a variety of gold compounds as sensitizers with good effect. The grains of the invention are robust and may be formed without the use of ripeners as required with many previous emulsions.

DETAILED DESCRIPTION OF THE INVENTION

The invention has numerous advantages over the prior art. The invention emulsions are rapidly developable. The silver chloride cubic emulsions of the invention provide a flat high intensity reciprocity failure (HIRF) and a lower contrast or exposure sensitometrics (softer toe), particularly with digital printing. The emulsions of the invention further have increased sensitivity allowing lower intensity lights for exposure. These and other advantages will be apparent from the detailed description below.

The above object of the present invention has been achieved by a light-sensitive silver halide photographic material comprising at least one silver halide emulsion layer wherein said silver halide emulsion contains silver halide grains having a silver chloride content of not less than 50% and said grains with a rounding index (measure of cubicity) of not larger than about 0.30 and at least one layer of photographic component layer including said silver halide layer at least one of a kind of another class of organic heterocyclic compound known as a dithiolone dioxide.

The dithiolone dioxide stabilizes AgCl chloride emulsions of the invention against fog growth under accelerated conditions and is the subject of U.S. Pat. No. 5,693,460. At levels in which the compound is active, there is a speed penalty. The combination of sulfinate and the dithiolone dioxide reduces the speed penalty and still provides the antifogging benefit in U.S. Pat. No. 4,670,307. U.S. application Ser. No. 08/885,483 relates to the combination of water soluble gold sensitizers with thiolone dioxide compounds for enhanced emulsion sensitivity. The present invention provides speed increases for emulsions with high cubicity (sharp corners) without the use of sulfinates. The gold sensitizer used is not limited to the use of water soluble gold compounds. Thus the commonly employed aurous sulfide may be used in the present invention. The sharp cornered AgCl cubic emulsion of the invention produces a flat HIRF and a softer toe that are desired for digital applications. Sharp AgCl cubic emulsion also significantly reduces sensitivity to wet abrasion and co-filed with Docket 75,608.

Dithiolone dioxide is a class of organic compound having a five-membered heterocyclic ring represented by formula (I):

(I)

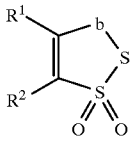

wherein b is C(O), C(S), C(Se), $CH_2$ or $(CH_2)_2$ and $R^1$ and $R^2$ may be independently H or a substituted or unsubstituted aliphatic, aromatic, or heterocyclic group, or $R^1$ and $R^2$ together represent the atoms necessary to form a ring or multiple ring system. Specific examples of the dithiolic compounds include, but are not limited to:

1

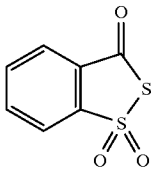

2

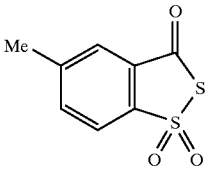

-continued

3

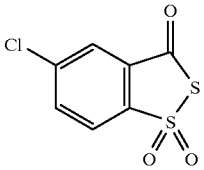

4

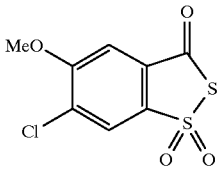

5

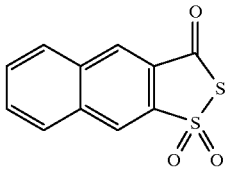

6

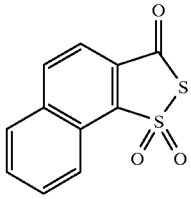

7

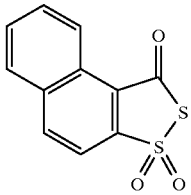

8

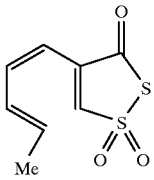

9

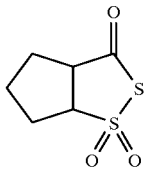

10

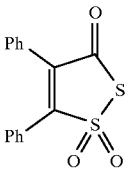

-continued
11
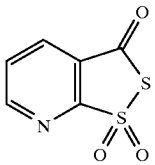
12
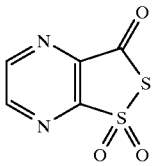
13
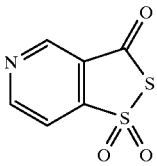
14
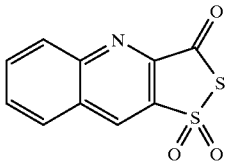
15
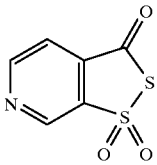
16
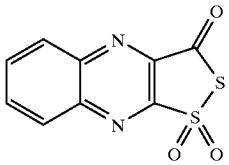
17
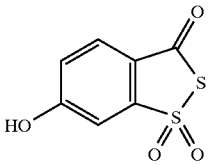
18
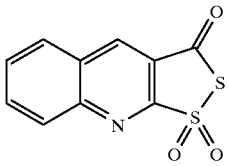
19
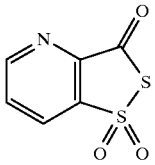
-continued
20
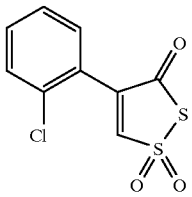
21
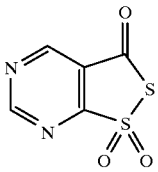
22
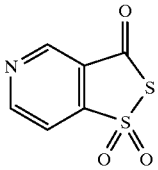
23
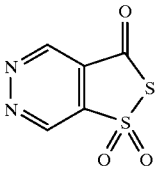
24
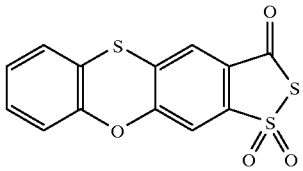
25
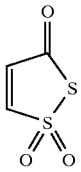
26
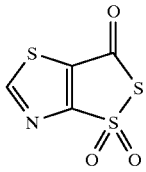
27
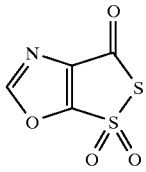

-continued

28

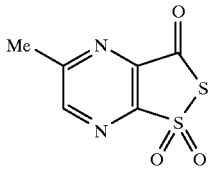

29

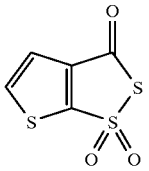

30

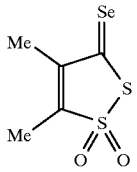

Cubicity measurement is based on the supersphere function that has only two parameters R and a. A third parameter must be added to account for the rotation of the model on an axis passing though the centroid. This parameter is the tangent of the angle of rotation (see Table A).

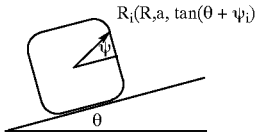

Generating an element of the model vector is performed by using the model parameters and the objects boundary points. The i-th model vector element is computed to be an angle corresponding to the i-th object boundary point minus the rotation angle (θ) of the model. To evaluate the model point, given the radius R, exponent (a), and tangent of the angle (tanθ=T), note that since $$R^a = x^a + y^a$$

$$T = y/x$$

$$R^a = x^a + y^a T^a \text{ and } x = R(1+T^a)^{(-1/a)}$$

$$\textit{similarly, } y = R(1+T^a)^{(-1/a)}$$

So that the radial component of the coordinate (the distance from the centroid) is $$R_i = R\sqrt{\left((1+T_i^a)^{-\frac{2}{a}} + (1+T_i^{-a})^{-\frac{2}{a}}\right)}$$

If $R_i$ is the distance of each boundary point from the centroid, and $R_i$ as computed above is the distance to the model curve from the centroid, then by forming a matrix from partial derivates of $R_i$, the Newton-Raphson problem is constructed. The elements of this vector are computed in such a way that there is a 1:1 correlation between the elements derived from the data and the elements computed here using the model function which has three parameters.

The value of parameter a is further used for estimation of rounding index, r, defined by the following equation:

$$r = 2/a$$

The evaluated in the above-described way rounding index, r, is equal to 0 for super cube and equal to 1 for supersphere. For 0.3 μm ripened AgCl cubes, the rounding index is about 0.5. Cubic grains of the present invention have rounding indexes of less than or equal to 0.3. A preferred rounding index for the emulsion of the invention is between 0.2 and 0.25 because this results in improved speed, shoulder, and contrast.

One method of preparing an aromatic 3H-1,2-dithiol-3-one 1,1-dioxide is via the cyclization of an ortho substituted aryl mercaptocarboxylic acid in the presence of thiolacetic acid. This is followed by oxidation of the product with hydrogen peroxide as described in OPPI Briefs 24, #4,488 (1992). Alternatively, this class of compounds may be purchased commercially.

Useful levels of dithiolone dioxides may range from 0.001 mg to 1000 mg per silver mole. Preferred range may be from 0.01 mg to 500 mg per silver mole. A more preferred range is from 0.1 mg to 100 mg per silver mole. The most preferred range is from 1 mg to 50 mg/Ag mole because this results in least fog growth with minimum speed loss.

The compounds of the present invention may be added any time during the preparation of the emulsion, but the preferred time of addition is during the precipitation or the sensitization of the emulsion.

The dithiolone dioxide compound may be added as an acetone solution or in gelatin dispersions. Methanol solutions, however, are to be specifically avoided because of the propensity of this class of compound to decompose in organic hydroxylic solvents.

The following examples illustrate the practice of this invention. They are not intended to be exhaustive of all possible variations of the invention.

EMULSION PRECIPITATION

Emulsion A

This AgCl cubic emulsion doped with osmium, ruthenium, and iridium is made without ripener in regular gelatin.

A 4.5 L mixture of gelatin (7.9%), NaCl (0.0257M), and a pluronic antifoamant (1.25 mL) was heated to 47° C. and the pCl adjusted to 1.7. To this stirred solution was added 27.7 mL of a 2.6M $AgNO_3$ solution and 33.9 mL of a 2.8M NaCl solution simultaneously at 27.7 mL/min for 1 minute. Then the simultaneous addition rates of the silver nitrate and the sodium chloride solutions were ramped linearly, increasing from 27.7 mL/min to 123 mL/min over 20 minutes. The simultaneous addition rates of the two solutions were maintained at 123 mL/min for another 40 minutes. During this time, various amounts of dopants were added. From 0 to 75% of the make, a solution of cesium pentachloronitrosyl osmate (II) (0.001 mg per mole of silver) was introduced. At 80 to 85% of the make, a solution of potassium hexacyano ruthenate (II) (25 mg per mole of silver) was introduced. At 93 to 95% of the make, a solution of potassium hexachloroiridate (0.04 mg per mole of silver) was introduced. The emulsion was cooled to 43° C. over 10 minutes. It was then washed using an ultrafiltration unit, and final pH and pCl were adjusted to 5.6 and 1.7 respectively. The resulting emulsion was a cubic grain silver chloride emulsion with a rounding index of 0.234, and of 0.30 μm in edgelength size.

Emulsion B

Emulsion B was made exactly as Emulsion A except that the silver nitrate solution contained 2.4 mg of compound 1 per mole of silver Emulsion C This AgCl cubic emulsion is made without ripener, but in low methionine gelatin and is doped with iridium.

A 5.0 L aqueous mixture of 7.9% low methionine gelatin, 0.0257M NaCl and 0.25 mL of a pluronic antifoaming agent was heated to 58° C. and the pCl adjusted to 1.7. To this stirred solution were added simultaneously 33 mL of a 2.8M NaCl solution and 35 mL of a 2.6M $AgNO_3$ solution containing 3.84 μmole of p-glutaramidophenyl disulfide per silver mole at a rate of 35 mL/min for 1 minute. Then the simultaneous addition rates of the silver nitrate and the sodium chloride solutions were ramped linearly, increasing from 35 mL/min to 123 mL/min over 20 minutes. The addition rates of the two solutions were maintained at 123 mL/min for another 34 minutes. At 93 to 95% of the make, a solution of potassium hexachloroiridate (0.04 mg per mole of silver) was introduced. The emulsion was cooled to 43° C. over 10 minutes. The emulsion was then washed using an ultrafiltration unit, and final pH and pCl were adjusted to 5.6 and 1.7 respectively. The resulting emulsion was a cubic grain silver chloride emulsion with a rounding index of 0.23, and of 0.38 μm in edgelength size.

Emulsion D

This AgCl cubic emulsion is made with ripener in regular gelatin and is doped with osmium.

A 7.37 L aqueous mixture of 4.0% gelatin, 0.0257M NaCl and 1.43 mL of a pluronic antifoaming agent was heated to 46.1° C. and the pCl adjusted to 1.7. 2,2'-(ethylenedithidiethanol) (112 mg/Ag mol) was added to the mixture before the introduction of the silver and salt streams. To this stirred solution were added simultaneously a 2.8M silver nitrate solution and a 3.0M sodium chloride solution at 226.1 mL/min for 15.8 minutes. From 0 to 93% of the make, a solution of cesium pentachloronitrosyl osmate (II) (1.65 mmole per mole of silver) was introduced. The emulsion was then cooled to 40° C. over 5 minutes. The emulsion was then washed using an ultrafiltration unit, and final pH and pCl were adjusted to 5.6 and 1.7 respectively. The resulting emulsion was a cubic grain silver chloride emulsion with a rounding index of 0.495, and of 0.30 μm in edgelength size.

SENSITIZATION OF EMULSIONS

EXAMPLE 1

In accordance with the present invention, a 0.2 mol of emulsion A was optionally sensitized with a green sensitizing dye 5-chloro-2-(2-((5-phenyl-3-(3-sulfobutyl)-2(3H)-benzoxazolylidene)methyl)-1-butenyl)-3-(3-sulfopropyl) benzoxazolium sodium salt(450 mg/Ag mole), followed by addition of a colloidal suspension of aurous sulfide in gelatin (25 mg/Ag mole) at 40° C. The emulsion was heated to 60° C. at a rate of 10° C. per 6 minutes and then held at this temperature for 30 minutes. The emulsion was cooled back to 40° C. at a rate of 10° C. per 6 minutes, and 1-(3-acetamidophenyl)-5-mercaptotetrazole (100 mg/Ag mol), and potassium bromide (795 mg/Ag mol) were added. This emulsion further contained a magenta dye-forming coupler 7-chloro-6-(1,1-dimethylethyl)-3-[3-(dodecylsulfonyl) propyl]-1H-pyrazolo[5,1-c]-1,2,4-triazole (0.318 g/m$^2$) in di-n-butylphthalate coupler solvent (0.27 g/m$^2$), gelatin (1.51 g/m$^2$). The emulsion (0.34 g Ag/m$^2$) was coated on a resin coated paper support and 1.076 g/m$^2$ gel overcoat was applied as a protective layer along with the hardener bis (vinylsulfonyl) methyl ether in an amount of 1.8% of the total gelatin weight.

Similarly, emulsion B was sensitized and coated as for emulsion A above.

The coatings were given a 0.1 second exposure, using a 0–3 step tablet (0.15 increments) with a tungsten lamp designed to stimulate a color negative print exposure source. This lamp had a color temperature of 3000K, log lux 2.95, and the coatings were exposed through a combination of magenta and yellow filters, a 0.3 ND (Neutral Density), and a UV filter. The processing consisted of a color development (45 sec, 35° C.), bleach-fix (45 sec, 35° C.) and stabilization or water wash (90 sec, 35° C.) followed by drying (60 sec, 60° C.). The chemistry used in the Colenta processor consisted of the following solutions:

| | |
|---|---|
| Developer | |
| Lithium salt of sulfonated polystyrene | 0.25 mL |
| Triethanolamine | 11.0 mL |
| N,N-diethylhydroxylamine (85% by wt.) | 6.0 mL |
| Potassium sulfite (45% by wt.) | 0.5 mL |
| Color developing agent (4-(N-ethyl-N-2-methanesulfonyl aminoethyl)-2-methyl-phenylenediaminesesquisulfate monohydrate | 5.0 g |
| Stilbene compound stain reducing agent | 2.3 g |
| Lithium sulfate | 2.7 g |
| Potassium chloride | 2.3 g |
| Potassium bromide | 0.025 g |
| Sequestering agent | 0.8 mL |
| Potassium carbonate | 25.0 g |
| Water to total of 1 liter, pH adjusted to 10.12 | |
| Bleach-fix | |
| Ammonium sulfite | 58 g |
| Sodium thiosulfate | 8.7 g |
| Ethylenediaminetetracetic acid ferric ammonium salt | 40 g |
| Acetic acid | 9.0 mL |
| Water to total 1 liter, pH adjusted to 6.2 | |
| Stabilizer | |
| Sodium citrate | 1 g |
| Water to total 1 liter, pH adjusted to 7.2. | |

The speed taken at the 1.0 density point of the D log E curve is taken as a measure of the sensitivity of the emulsion. Fog (Dmin) is measured as the minimum density above zero. Toe at 0.3 is taken as the density at 0.3 log E fast of the density point of 1. Shoulder is taken as the density at 0.3 log E slow of the density point of 1.0. Gamma (contrast) is the slope of the line between the density points that are 0.3 log E faster and 0.3 log E slower than the density point at 1.0.

TABLE 1

| Sample | mg of 1 Ag mol | Speed | $D_{min}$ | Toe | Shoulder | Contrast |
|---|---|---|---|---|---|---|
| 1 (comparison) | 0 | 118 | 0.123 | 0.588 | 1.626 | 1.560 |
| 2 (invention) | 2.4 | 158 | 0.118 | 0.320 | 1.965 | 2.735 |

Data in Table 1 show that the invention sample (2) in which an unripened silver chloride emulsion (B), with rounding index of 0.234, is doped with compound 1 during the make, exhibits a significant speed increase compared to the same emulsion (A) without compound 1. Importantly, in addition to the speed increase, there is also lower fog (Dmin), a sharper toe, higher shoulder resulting in an overall higher contrast when compound 1 is present during the precipitation of the unripened silver chloride cubic emulsion.

EXAMPLE 2

In another practice of the present invention, a 0.2 mol of emulsion C was optionally sensitized with a green sensitizing dye 5-chloro-2-(2-((5-phenyl-3-(3-sulfobutyl)-2(3H)-benzoxazolylidene)methyl)-1-butenyl)-3-(3-sulfopropyl) benzoxazolium sodium salt (450 mg/Ag mole) followed by addition of hypo (0.5 mg/Ag mole), and bis(1,4,5-trimethyl- 1,2,4-triazolium-3-thiolate) gold(I) tetrafluoroborate, (6 mg/Ag mole) at 40° C. The emulsion was heated to 60° C. over 12 minutes and held at this temperature for 30 minutes. Then the emulsion was cooled to 40° C. and 100 mg of 1-(3-acetamidophenyl)-5-mercaptotetrazole per mole of silver was added followed by addition of 795 mg of potassium bromide per mole of silver.

Similarly, another 0.2 mol of emulsion C was sensitized as above, except that 6 mg of compound 1 per mole of silver was added as the first addendum in the sensitization. The emulsions were coated, exposed, and processed as in Example 1.

TABLE 2

| Sample | mg of 1 Ag mol | Speed | $D_{min}$ | 0.3 Toe | Shoulder | Contrast |
|---|---|---|---|---|---|---|
| 3 (comparison) | 0 | 130 | 0.132 | 0.526 | 1.600 | 1.676 |
| 4 (invention) | 6 | 140 | 0.132 | 0.435 | 1.849 | 2.206 |

This example compares unripened silver chloride emulsions, with a rounding index of 0.23, made in low methionine gelatin and sensitized in the presence of compound 1 (sample 4) with the same emulsion sensitized without compound 1. Table 2 shows a speed increase of the emulsion of the present invention compared to sample (3) which is not sensitized in the presence of compound 1. Significant improvement in shoulder and contrast are also observed as in Example 1.

EXAMPLE 3

Emulsion D, with a rounding index of about 0.5, made in the presence ripener was similarly sensitized as in Example 2 with compound 1 in amounts indicated in Table 3 was also added at the beginning of the sensitization process. The emulsions were coated, exposed, and processed as in Example 1.

TABLE 3

| Sample | mg of 1 Ag mol | Speed | Dmin | 0.5 Toe | 0.3 Toe | Shoulder | Contrast |
|---|---|---|---|---|---|---|---|
| 5 (comparison) | 0 | 182 | 0.093 | 0.171 | 0.349 | 1.952 | 2.672 |
| 6 (comparison) | 6 | 169 | 0.096 | 0.182 | 0.392 | 1.896 | 2.508 |
| 7 (comparison) | 8 | 164 | 0.094 | 0.180 | 0.384 | 1.930 | 2.578 |
| 8 (comparison) | 10 | 160 | 0.092 | 0.180 | 0.383 | 1.916 | 2.555 |
| 9 (comparison) | 12 | 136 | 0.092 | 0.154 | 0.304 | 2.124 | 3.033 |

This example illustrates the use of dithiolone dioxides of the present invention in ripened emulsions with rounding index of greater than 0.3 does not give the speed increase seen in unripened emulsions. Indeed, there is a speed loss when dithiolone dioxides are used with ripened emulsions.

The invention has been described in detail with particular reference to the preferred embodiments thereof, but it will be understood that variations and modifications can be effected within the scope of the invention.

What is claimed is:

1. An emulsion comprising sharp cornered cubic silver chloride grains, said grains having a rounding index less than 0.3 and a dithiolone dioxide wherein said emulsion is free of ripeners.

2. The emulsion of claim 1 wherein said dithiolone dioxide comprises between 0.1 and 500 mg/Ag mol.

3. The emulsion of claim 1 wherein said emulsion is a negative emulsion.

4. The emulsion of claim 1 wherein said grains are greater than 99 percent chloride.

5. The emulsion of claim 1 wherein the rounding index is between 0.2 and 0.25.

6. The emulsion of claim 1 wherein said dithiolone dioxide is selected from the group consisting of

1

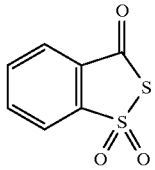

2

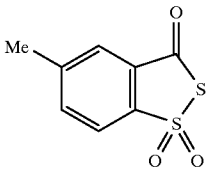

3

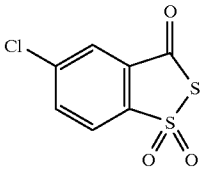

-continued

4

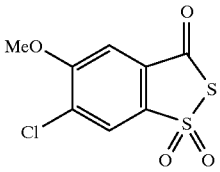

5

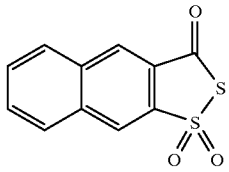

-continued
6
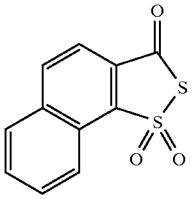
7
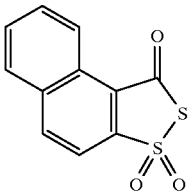
8
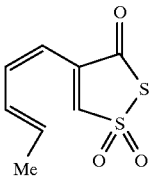
9
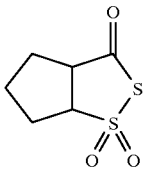
10
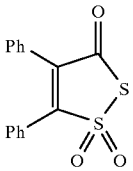
11
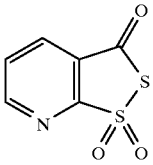
12
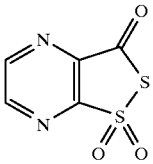
13
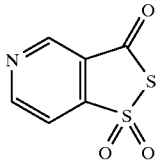
-continued
14
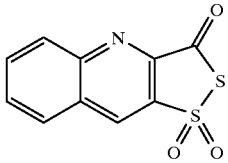
15
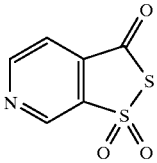
16
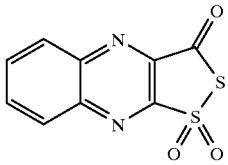
17
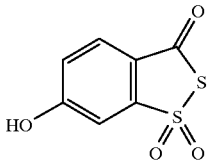
18
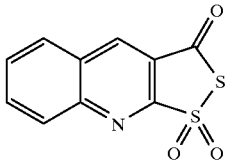
19
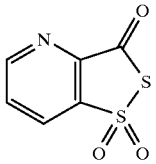
20
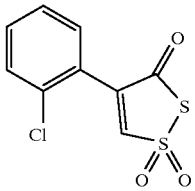
21
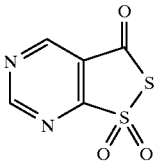

-continued

22

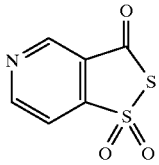

23

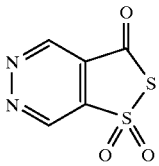

24

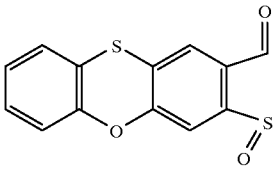

25

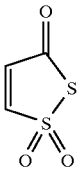

26

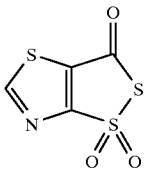

27

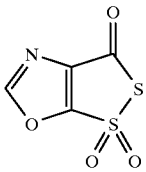

28

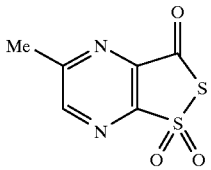

29

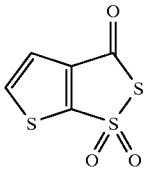

-continued

30

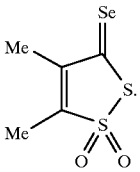

7. A method of emulsion formation for a sharp cornered cubic silver chloride grain comprising forming a high chloride emulsion with the proviso that dithiolone dioxide is added during the emulsion make or finish and that the emulsion is free of ripeners during precipitation.

8. The method of claim 7 wherein said dithiolone dioxide comprises between 0.1 and 500 mg/Ag mol.

9. The method of claim 7 wherein said emulsion is a negative emulsion.

10. The method of claim 7 wherein said grains have a rounding index of less than 0.3.

11. The method of claim 10 wherein said rounding index is between 0.2 and 0.25.

12. A photographic element comprising at least one layer comprising an emulsion comprising sharp cornered cubic silver chloride grains, said grains having a rounding index less than 0.3, dithiolone dioxide, and a dye forming coupler, and wherein said at least one layer is free of ripeners.

13. The element of claim 12 wherein said dithiolone dioxide comprises between 0.1 and 500 mg/Ag mol.

14. The element of claim 12 wherein said element is a negative working photographic element.

15. The element of claim 12 wherein said grains are greater than 99 percent chloride.

16. The element of claim 12 wherein the rounding index is between 0.2and 0.25.

17. The element of claim 12 wherein said dithiolone dioxide compound is selected from the group consisting of

1

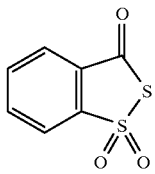

2

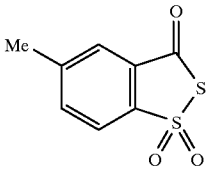

3

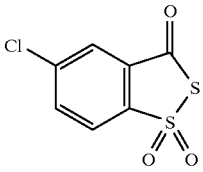

-continued
4
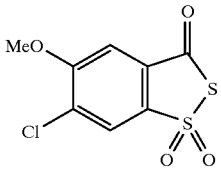
5
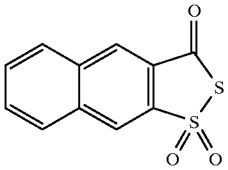
6
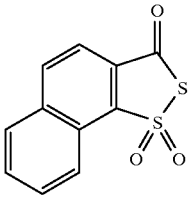
7
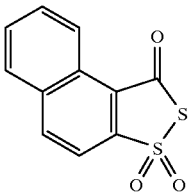
8
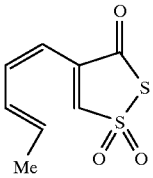
9
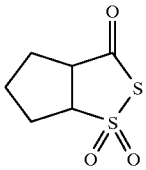
10
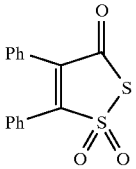
11
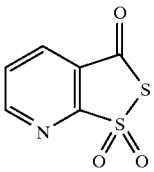
-continued
12
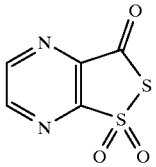
13
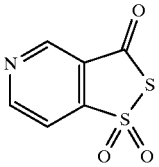
14
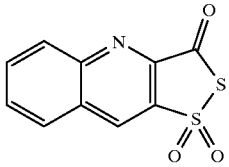
15
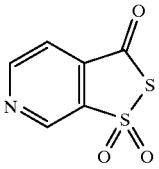
16
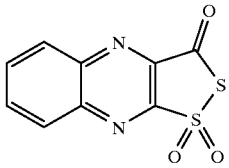
17
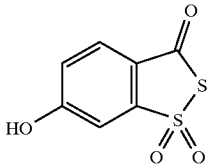
18
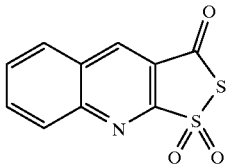
19
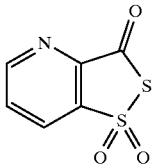

-continued
20
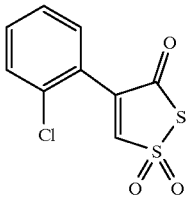
21
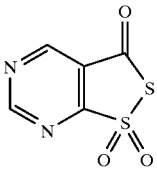
22
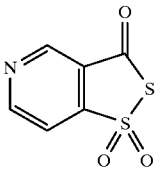
23
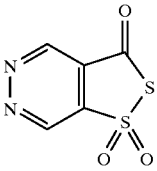
24
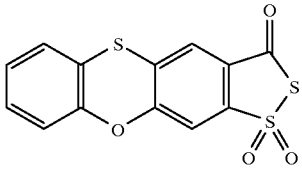
25
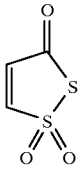
-continued
26
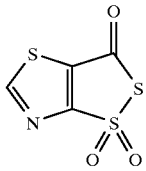
27
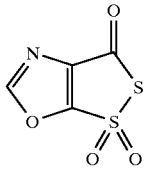
28
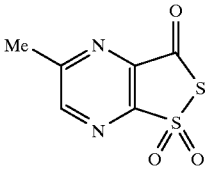
29
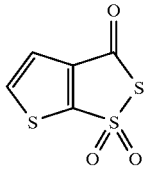
30
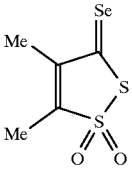
* * * * *